United States Patent [19]

Murai

[11] Patent Number: 4,613,563

[45] Date of Patent: Sep. 23, 1986

[54] SILVER HALIDE PHOTOGRAPHIC LIGHT-SENSITIVE MATERIAL

[75] Inventor: Ashita Murai, Kanagawa, Japan

[73] Assignee: Fuji Photo Film Co., Ltd., Kanagawa, Japan

[21] Appl. No.: 696,229

[22] Filed: Jan. 29, 1985

[30] Foreign Application Priority Data

Jan. 31, 1984 [JP] Japan ..... 59-15504

[51] Int. Cl.[4] ..... G03C 5/24

[52] U.S. Cl. ..... 430/523; 430/506; 430/539; 430/211; 430/217; 430/220; 430/940; 430/598; 430/409; 430/410

[58] Field of Search ..... 430/506, 220, 217, 212, 430/523, 598, 940, 539, 409, 410

[56] References Cited

U.S. PATENT DOCUMENTS

| | | | |
|---|---|---|---|
| 3,923,513 | 12/1975 | Evans | 430/409 |
| 4,332,885 | 6/1982 | Ohmatsu | 430/509 |
| 4,356,250 | 10/1982 | Irani et al. | 430/216 |
| 4,461,826 | 7/1984 | Yamashita et al. | 430/506 |
| 4,504,570 | 3/1985 | Evans et al. | 430/598 |

OTHER PUBLICATIONS

Research Disclosure, 14140, Jan. 1976, pp. 34–38.

*Primary Examiner*—Won H. Louie

*Attorney, Agent, or Firm*—Sughrue, Mion, Zinn, Macpeak & Seas

[57] ABSTRACT

A silver halide photographic light-sensitive material comprising a support having provided thereon at least one internal latent image type direct positive silver halide emulsion layer is disclosed, wherein (1) said internal latent image type direct positive silver halide emulsion layer comprises at least two layers having substantially the same color sensitivity, or (2) at least said internal latent image type direct positive silver halide emulsion and a solid pigment-containing layer contiguous thereto, which is positioned on the side opposite to the side of the silver halide emulsion layer to be exposed, are provided, and wherein at least one internal latent image type direct positive silver halide emulsion in (1) or (2) has a binder/silver halide (calculated as silver) ratio by weight of more than 1.25.

7 Claims, No Drawings

SILVER HALIDE PHOTOGRAPHIC LIGHT-SENSITIVE MATERIAL

FIELD OF THE INVENTION

This invention relates to a photographic light-sensitive material and, more particularly, to an internal latent image type direct positive silver halide photographic light-sensitive material.

BACKGROUND OF THE INVENTION

In producing silver halide photographic light-sensitive materials, it is well known to form silver halide in a binder (protective colloid) such as gelatin and coat the resulting emulsion on a support. However, silver halide and the binder are conventionally used in a proportion of about 1:1 in terms of the ratio of silver halide (calculated as silver) to binder. This applies not only to "surface latent image type emulsions" (negative-working emulsions) which form latent images predominantly on the surface of the silver halide grains but also to "internal latent image type emulsions" which form latent images predominantly inside the silver halide grains and which are used as direct positive emulsions for forming direct positive images as well.

Specific examples of the binder-to-silver ratio in light-sensitive materials having internal latent image type direct positive emulsion layer are described below. In Example 9 described in U.S. Pat. No. 3,923,513, the ratios are 1.2 (red-sensitive layer), 0.9 (green-sensitive layer), and 1.0 (blue-sensitive layer) and, in Example 11, the ratios are 0.8 (red-sensitive layer), 0.83 (green-sensitive layer), and 0.67 (blue-sensitive layer).

In U.S. Pat. No. 4,356,250 which discloses incorporating zinc oxide in an interlayer provided between a green-sensitive layer and a blue-sensitive layer, the ratio is 1.0 (in all of red-, green- and blue-sensitive layers) and, in Japanese Patent Application (OPI) No. 17435/83 (the term "OPI" as used herein refers to a "published unexamined Japanese patent application") which discloses incorporating a solid pigment such as titanium white in an interlayer provided between an internal latent image type emulsion layer and a layer containing a dye providing compound, the ratio is 0.79. Further, in U.S. Pat. No. 4,332,885 which discloses providing a plurality of internal latent image type emulsions having the same color sensitivity, the ratio is 1.0 to 1.17.

Of the photographic light-sensitive materials having internal latent image type direct positive silver halide emulsion layers, those which contain at least one silver halide emulsion layer unit comprising at least two internal latent image type direct positive silver halide emulsion layers with substantially the same color sensitivity and different light sensitivities as disclosed in above-mentioned U.S. Pat. No. 4,332,885 have the advantage, in comparison with those in which at least two emulsions are mixed in place of providing a plurality of layers, in that:

(1) higher sensitivity can be attained since optional amounts of sensitizers, nucleating agents, etc., to be added to respective silver halide emulsion layers can be selected;

(2) the problem of "processing temperature dependence", i.e., that the image density varies depending upon the processing temperature, can be solved to some extent; and (3) gradation can be easily controlled.

Therefore, photographic light-sensitive materials of this type are excellent for forming photographs with high image quality.

In addition, photographic light-sensitive materials of the type which have a solid pigment-containing layer contiguous to an internal latent image type direct positive silver halide emulsion layer as disclosed in Japanese Patent Application (OPI) No. 17435/83 are also excellent for forming photographs with high image quality, because they prevent inhibition of silver development and, therefore, show enhanced sensitivity.

However, light-sensitive materials of these types have a common technical problem of poor storage stability, the reason therefore not being well understood. Thus, solution of this problem is of importance for providing photographs having better image quality.

SUMMARY OF THE INVENTION

It is, therefore, an object of the present invention to provide an internal latent image type direct positive silver halide light-sensitive material having an improved storage stability.

This and other objects of the present invention will become apparent from the following descriptions thereof.

As a result of intensive investigations, the inventors have found that a silver halide photographic light-sensitive material comprising a support having provided thereon at least one internal latent image type direct positive silver halide emulsion layer, wherein:

(1) said internal latent image type direct positive silver halide emulsion layer comprises at least two layers having substantially the same color sensitivity, or (2) at least said internal latent image type direct positive silver halide emulsion and a solid pigment-containing containing layer contiguous thereto which is positioned on the side opposite to the side of the silver halide emulsion layer to be exposed, are provided, and wherein at least one internal latent image type direct positive silver halide emulsion in (1) or (2) has a binder/silver halide (calculated as silver) ratio by weight of more than 1.25. Such a photographic material has an effectively improved storage stability and, even after a long time of storage, provides an image having high maximum density ($D_{max}$) and low minimum density ($D_{min}$).

DETAILED DESCRIPTION OF THE INVENTION

Particularly remarkable effects of the present invention can be obtained when the binder/silver ratio by weight in an internal latent image type direct positive silver halide emulsion layer contiguous to a layer which influences storage stability of the silver halide emulsion (for example, the aforesaid solid pigment-containing layer, an interlayer containing a color mixing preventing agent, a layer containing a dye providing compound, etc.) is adjusted to more than 1.25, and the greatest effects can be obtained when the binder/silver ratio by weight in one of a plurality of internal latent image type direct positive silver halide emulsion layers having the same color sensitivity (but having different light sensitivity) contiguous to a solid pigment-containing layer is adjusted as mentioned above.

As the binder/silver ratio by weight, more than 1.25 is effective, with more than 2.0 being more preferable, and more than 3.0 being most preferable.

The binder/silver ratio by weight is a value calculated by dividing the weight of binder (solids) used for making the internal latent image type silver halide emulsion layer by the weight of silver of silver halide contained in the layer.

As the internal latent image type direct positive silver halide emulsion layer composed of a plurality of silver halide emulsion layers having the same color sensitivity, any of a blue-sensitive layer, a green-sensitive layer and a red-sensitive layer may be selected. It is particularly preferable to constitute these three layers by a plurality of sub-layers. The emulsion layers having the same color sensitivity to be used to constitute one internal latent image type direct positive silver halide emulsion layer unit are preferably different from each other in light sensitivity.

Specific examples of color mixing preventing agents to be incorporated in an interlayer of the light-sensitive material of the present invention include dihydroxybenzene derivatives described in U.S. Pat. Nos. 2,336,327, 2,360,290, 2,403,721, 3,700,453 and 2,701,197, Japanese Patent Application (OPI) Nos. 2128/71, 29637/79, 9528/78 and 52056/80, etc., dihydroxynaphthalene derivatives, aminoaphthol derivatives, sulfonamidophenol derivatives, sulfonamidonaphthol derivatives, etc.

These compounds must have a ballast group in order to effectively function as color mixing preventing agents.

The color mixing preventing agent is coated in an amount of about $1\times10^{-4}$ to about $1\times10^{-2}$ mol/m$^2$, preferably $5\times10^{-4}$ to $5\times10^{-3}$ mol/m$^2$.

As the solid pigment to be used in the present invention, those disclosed in, for example, Japanese Patent Application (OPI) No. 17435/83 are suitable.

That is, white pigments such as titanium oxide, zinc oxide, zirconium oxide, white lead, zinc sulfide, etc., colored pigments such as cadmium yellow, cobalt silver, cobalt blue, cadmium red, ultramarine, indanthrone blue, phthalocyanine blue, and pearl pigments disclosed in Japanese Patent Publication Nos. 25644/68, 3897/73, 3824/74, 11727/74, 11728/74, 11729/74, 49173/74, 49174/74, 6172/76 and 3406/79 can be used. Pearl pigments are usually produced by coating the above-described white and/or colored pigment on core portions of thin plates in an enough thickness to give preferable optical properties. However, the pigments to be used in the present invention are not limited to those obtained by these processes using these materials. Particularly preferable pigments include titanium oxide, zirconium oxide, and various pearl pigments. As such titanium oxide, zirconium oxide, and various pearl pigments, commercially available ones may be used. Particularly, as the pearl pigments, those which are sold under the trade names of Flamenco-Blue 100, Flamenco-Green 100 and Flamenco-Red 100 by Mearl Co. can be used.

Preferable pearl pigments have a thin core of 1 μm or less in thickness, with pearl pigments having no core prepared by coating a pearl pigment on cores in a coating thickness of giving preferable optical properties and removing the cores by chemical and/or physical process being more preferable.

In addition, silver halide grains (of preferably 0.2 μm or less in size) which have a sensitivity of 1/10 or less of the sensitivity of the emulsion used for the silver halide emulsion layer and which do not substantially influence sensitivity, gradation, $D_{max}$ and $D_{min}$ may also be used.

These solid pigments usually have a refractive index different from that of the hydrophilic colloid by 0.1 or more, and hence they have a secondary effect of enhancing sensitivity of the light-sensitive element because, upon exposure, light having once traveled through the silver halide emulsion layer again travels through the layer due to reflection, scattering, interference, etc., by the pigment.

As solid pigments to be incorporated in a spacer layer provided between a blue-sensitive internal latent image type silver halide emulsion layer and a layer containing a yellow dye providing compound, those which reflect only blue light and which transmit yellow light are preferably selected. As solid pigments to be used in a spacer layer between a green-sensitive internal latent image type silver halide emulsion layer and a layer containing a magenta dye providing compound, those which reflect only green light and transmit red light are preferably selected.

The preferred coating amount of pigment in the pigment-containing layer is about 10 g/m$^2$ or less, more preferably from 0.5 to 4 g/m$^2$, depending upon the material used.

The internal latent image type direct positive silver halide emulsion to be used in the present invention is not particularly limited, and any of known ones may be used. For example, "conversion type" emulsions prepared by utilizing the difference in solubility of the silver halide and "core/shell type" silver halide emulsions which comprise an internal nucleus (core) of silver halide having been doped with a metal ion and/or chemically sensitized and an outer shell (shell) of silver halide covering at least light-sensitive sites of said internal nucleus can be used, with the core/shell type emulsions being preferable.

Doping of cores of the core/shell type silver halide grains to be used in the present invention with metal ion may be effected, for example, by allowing a metal ion source such as a cadmium salt, zinc salt, lead salt, thallium salt, iridium salt or its complex salt thereof, rhodium salt or its complex salt, iron salt or its complex salt, or the like in the stage of forming or physically ripening the core silver halide grains. The metal ion is usually used in an amount of $10^{-6}$ mol or more per mol of silver halide. The core of silver halide grains may be chemically sensitized with one or more noble metal sensitizers, sulfur sensitizers, and reduction sensitizers in place of, or together with, the above-described doping with a metal ion. Metal sensitization and sulfur sensitization provide a particularly enhanced sensitivity. Such processing of core of silver halide grains and techniques of covering the surface of core-constituting silver halide grains with a shell of silver halide are known, and such processes and techniques are described in, for example, U.S. Pat. Nos. 3,206,316, 3,317,322, and 3,367,778 (excluding the step of fogging surface of grains), and 3,761,276.

The amount of shell silver halide is optional but it suitably ranges from 0.2 to 12 mols per mol of core silver halide and it preferably ranges from 0.5 to 8 mols per mol of core silver halide.

The composition of the core silver halide and that of the shell silver halide are preferably the same, but may be different from each other. In the present invention, as core and shell silver halides, silver bromide, silver iodide, silver chloride, silver chlorobromide, silver bromoiodide, silver chlorobromoiodide, etc., may be used. Preferable silver halide comprises at least 50 mol % silver bromide. More preferable silver halide comprises 80 to 100 mol % silver bromide and the balance silver chloride and/or silver iodide. The most preferable embodiment employs silver bromide as both the core and shell.

In the present invention, core/shell silver halide grains of various grain sizes may be used. Core/shell silver halide grains of about 0.1 to about 2.5 μm, preferably about 0.2 to about 2.5 μm, particularly preferably about 0.8 to about 2.0 μm, provide good results.

The core/shell silver halide grains may be in a regular crystal form such as cubic or octahedral form, in an irregular crystal form such as spherical or tabular form or in a mixed form thereof, or may comprise a mixture of grains in different forms. As tabular crystal form, internal latent image type core/shell silver halide emulsions, those described in, for example, European Pat. No. 79,583 and British Pat. Nos. 2,111,706A and 2,110,831A are useful.

Such core/shell silver halide grains of the present invention are dispersed in a binder as is well known.

As the binder, gelatin is advantageously used. However, other hydrophilic colloids can be used as well. For example, proteins such as gelatin derivatives, graft polymers between gelatin and other high polymer, albumin, casein, etc.; cellulose derivatives such as hydroxyethyl cellulose, carboxymethyl cellulose, cellulose sulfate, etc.; and sugar derivatives such as sodium alginate, starch derivative, etc., can be used.

As gelatin, acid-processed gelatin or enzyme-processed gelatin as described in *Bull. Soc. Sci. Phot. Japan*, No. 16, p. 30 (1966) may be used as well as lime-processed gelatin, and a gelatin hydrolyzate or an enzyme-decomposed product can be used. As the gelatin derivatives, those obtained by reacting gelatin with various compounds such as acid halides, acid anhydrides, isocyanates, bromoacetic acid, alkanesultones, vinylsulfonamides, maleinimide compounds, polyalkylene oxides, epoxy compounds or the like can be used. Specific examples thereof are described in U.S. Pat. Nos. 2,614,928, 3,132,945, 3,186,846, 3,312,553, British Pat. Nos. 861,414, 1,033,189 and 1,005,784, and Japanese Patent Publication No. 26845/67, etc.

As the aforesaid gelatin graft polymers, products prepared by grafting to gelatin a homo- or copolymer of vinyl monomer such as acrylic acid, methacrylic acid, ester or amide thereof, acrylonitrile, styrene, or the like can be used. In particular, graft polymers between gelatin and a polymer having some compatibility with gelatin such as a polymer of acrylic acid, methacrylic acid, acrylamide, methacrylamide, hydroxyalkyl methacrylate or the like are preferable. Examples of these are described in U.S. Pat. Nos. 2,763,625, 2,831,767, 2,956,884, etc.

Typical synthetic high molecular substances are those described in, for example, West German Patent Application (OLS) No. 2,312,708, U.S. Pat. Nos. 3,620,751 and 3,879,205, and Japanese Patent Publication No. 7561/68.

The photographic emulsion or the like may contain substantially non-film forming inert particles (preferably polymer latex) which is substantially non-swelling in an aqueous alkali and which is compatible with gelatin, with the amount thereof preferably being not more than 50 wt % based on the weight of gelatin, for improving permeability of a processing solution and other purposes. As such polymer latex, latexes of acrylic or methacrylic acid polymers (homopolymers or copolymers), styrene polymers (homopolymers or copolymers) may be used.

Silver halide grains of the photographic emulsion to be used in the present invention are not required to be chemically sensitized, but may be chemically sensitized to some extent. In addition, the photographic emulsion may be spectrally sensitized with a methine dye or the like.

The photographic emulsion to be used in the present invention gives a direct positive image when developed in the presence of a nucleating agent or under uniform exposure. As the typical nucleating agents to be used for this purpose, there are hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Patent Application (OPI) No. 69613/77, U.S. Pat. Nos. 3,615,615, 3,719,494, 3,734,738, 4,094,683, 4,115,122, etc.; sensitizing dyes having a nucleating substituent in dye moiety described in U.S. Pat. No. 3,718,470; thiourea-bound type acylhydrazine compounds described in U.S. Pat. Nos. 4,030,925, 4,031,127, 4,245,073, 4,255,511, 4,266,013, and 4,276,364, British Pat. No. 2,012,443, etc.; urea-bound type acylhydrazine compounds described in U.S. Pat. No. 4,374,923, etc.; and acylhydrazine type compounds having a heterocyclic group such as a thioamido ring, a triazole ring or a tetrazole ring as an adsorptive group described in U.S. Pat. Nos. 4,080,270 and 4,278,748, British Pat. No. 2,011,391B, etc.

The nucleating agent is desirably used in such amount that enough maximum density is obtained by developing the photographic emulsion of the present invention with a surface developer. In practice, the amount varies depending upon the characteristic properties of the silver halide emulsion used, the chemical structure of the nucleating agent used, and the developing conditions, and thus ranges over a wide scope. In the case of adding the nucleating agent to a developer, the amount of the nucleating agent is generally about 0.01 g to about 5 g (preferably 0.05 g to 1 g) per liter of developer. In the case of adding to an emulsion layer, a practically useful amount of the nucleating agent ranges from about 0.1 mg to about 5 g per mol of silver in the photographic emulsion, preferably about 0.5 mg to about 2 g per mol of silver. In the case of incorporating the nucleating agent in a hydrophilic colloidal layer adjacent to the emulsion layer, the nucleating agent is incorporated in the same amount as described above based on the amount of silver contained in the photographic emulsion of the same area. The nucleating agent is preferably added to a photographic emulsion or its contiguous layer.

The light-sensitive material of the present invention may be adapted for use in a black-and-white process or color photographic process. Specific applications of the light-sensitive material include photographing light-sensitive materials, light-sensitive materials for prints, light-sensitive materials for photomechanical process, light-sensitive materials for X-ray, light-sensitive materials of microphotography, diffusion transfer process light-sensitive materials, heat developable light-sensitive materials, light-sensitive materials for silver dye bleaching process, light-sensitive materials for cinema, etc. Thus, the light-sensitive material of the present invention can find wide applications.

In the case of using the light-sensitive material of the present invention as color light-sensitive sensitive materials, various dye providing compounds are used therein. One type of the most typical dye providing compounds are couplers. As the couplers, non-diffusible couplers having a hydrophobic group called a ballast group are desirable. The couplers may be of either 4-equivalent type or 2-equivalent type based on the silver ion. Colored couplers having a color correcting effect or couplers capable of releasing a development inhibitor upon development (called DIR couplers) may also be incorporated. The coupler may be that which forms a colorless coupling reaction product.

As yellow color forming couplers, known open chain ketomethylene couplers may be used. Of these, benzoylacetanilide type and pivaloylacetanilide type compounds are advantageous.

As magenta color forming couplers, pyrazolone compounds, indazolone compounds, cyanoacetyl compounds, etc., may be used, with pyrazolone compounds being particularly preferable. Pyrazolotriazole compounds, pyrazoloimidazole compounds, pyrazolopyrazole compounds, etc., are also useful.

As cyan color forming couplers, phenolic compounds, naphtholic compounds, etc., may be used.

In addition, colored couplers, DIR couplers (particularly DIR couplers capable of releasing a development inhibitor with a large diffusibility) may be used together.

In addition to DIR couplers, compounds capable of releasing a development inhibitor upon development may be incorporated in the light-sensitive material. For example, those described in U.S. Pat. Nos. 3,297,445 and 3,379,529, West German Patent Application (OLS) No. 2,417,914, Japanese Patent Application (OPI) Nos. 15271/77 and 9116/78 may be used.

Two or more different couplers may be incorporated in one and the same layer, or one and the same compound may be incorporated in two or more different layers.

The couplers are generally added in amounts of about $2\times10^{-3}$ mol to about $5\times10^{-1}$ mol, preferably $1\times10^{-2}$ mol to $5\times10^{-1}$ mol, per mol of silver in an emulsion layer.

In the case of using the light-sensitive material of the present invention for a color diffusion transfer process, dye developers may be used as dye providing compounds. However, the use of dye providing compounds of the type which are nondiffusible (immobile) in alkalinity (in a developer) but which, as a result of development, release a diffusible dye (or its precursor) is more advantageous. As the diffusible dye releasing type dye providing compounds, there are diffusible dye releasing couplers and diffusible dye releasing redox compounds, which are useful not only for a color diffusion transfer process (wet process) but for heat developable light-sensitive materials (dry process) as well.

The diffusible dye releasing redox compounds (hereinafter referred to as "DRR compounds") can be represented by the following general formula:

Y—D wherein Y represents a redox center which functions to release a diffusible dye as a result of development and to which a ballast group is bound for immobilizing the compound; and D represents a dye (or its precursor) moiety which may optionally be attached to the redox center via a linking group.

Specific examples of Y are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,139,379, 4,218,368, 3,421,964, 4,199,355, 4,199,354, 4,278,750, 4,135,929, 4,336,322, 4,371,604 and 4,139,389, Japanese Patent Application (OPI) Nos. 50736/78, 4819/77, 104343/76, 103122/79, 110827/78, 12642/81, 16131/81, 4043/82, 650/82, 20735/82, 69033/78, 130927/79, 164342/81 and 119345/82, etc.

As to the dye moiety represented by D, specific examples of yellow dyes are those described in U.S. Pat. Nos. 3,597,200, 3,309,199, 4,013,633, 4,245,028, 4,156,609, 4,139,383, 4,195,992, 4,148,641, 4,148,643 and 4,336,622, Japanese Patent Application (OPI) Nos. 114930/76 and 71072/81, Research Disclosure, 17630 (1978), ibid., 16475 (1977), etc., specific examples of magenta dyes are those described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, Japanese Patent Application (OPI) Nos. 106727/77, 23628/78, 36804/80, 73057/81, 71060/81 and 134/80, and specific examples of cyan dyes are those described in U.S. Pat. Nos. 3,482,972, 3,929,760, 4,013,635, 4,268,625, 4,171,220, 4,242,435, 4,142,891, 4,195,994, 4,147,544 and 4,148,642, British Pat. No. 1,551,138, Japanese Patent Application (OPI) Nos. 99431/79, 8827/77, 47823/78, 143323/78, 99431/79, and 71061/81, European Patent (EPC) No. 53,037 and 53,040, *Research Disclosure,* 17630 (1978) and ibid., 16475 (1977).

These compounds are generally coated in an amount of about $1\times10^{-4}$ to about $1\times10^{-2}$ mol/m$^2$, preferably $2\times10^{-4}$ to $2\times10^{-2}$ mol/m$^2$.

As the support to be used in the light-sensitive material of the present invention, any of flexible or nonflexible ones that possess a good dimensional stability may be used, any of those which are generally used in the photographic field being usable. Above all, paper, laminated or coated paper, synthetic high polymer film (cellulose triacetate, polyester, etc.), etc., are preferably used.

In the case of using DRR compounds as dye providing compounds, any silver halide developing agent (or electron donative agent) that can cross-oxidize the DRR compound may be used, with 3-pyrazolidones being preferable.

When used for diffusion transfer photographic film units, the light-sensitive material of the present invention is preferably processed with a viscous developer. This viscous developer is a liquid composition containing processing ingredients necessary for developing a silver halide emulsion (and for formation of diffusion transfer dye image). A major component of the developer is water and, in some cases, hydrophilic solvents such as methanol and methyl cellosolve are contained.

Preferably, the processing composition contains a hydrophilic polymer such as polyvinyl alcohol, hydroxyethyl cellulose, sodium carboxymethyl cellulose, etc. These polymers are used to give the resulting processing composition a viscosity of 1 poise or more, preferably about 500 to 1,000 poises, at room temperature.

The above-described processing composition is preferably retained in a rupturable container by pressure as described in U.S. Pat. Nos. 2,543,181, 2,643,886, 2,653,732, 2,723,051, 3,056,491, 3,056,492 and 3,152,515, etc.

In adapting the light-sensitive material of the present invention to a color diffusion transfer process, the photographic emulsions may be coated on the same support on which an image receiving layer has been coated to prepare an integral light-sensitive material, or may be coated on a different support. In addition, it may be formed as a film unit wherein a silver halide photographic emulsion layer (light-sensitive element) is combined with an image receiving layer (image receiving element), or as a photographic material wherein the two elements are separated from each other. The film unit may be in an integral form throughout exposure, development, and viewing of transferred image, or may be a type of peeling apart after development.

The present invention is now illustrated in greater detail by reference to the following examples which, however, are not to be construed as limiting the present invention in any way.

EXAMPLE 1

Light-Sensitive Element I in accordance with the present invention was prepared by coating the following layers, in the order recited, on a transparent polyethylene terephthalate film support.

(1) an image receiving layer containing 4.0 g/m$^2$ of copoly(styrene-N-vinylbenzyl-N,N,N-trihexylammonium chloride) and 4.0 g/m$^2$ of gelatin;

(2) a white reflecting layer containing 22 g/m$^2$ of titanium dioxide and 2.2 g/m$^2$ of gelatin;

(3) an opaque layer containing 2.7 g/m$^2$ of carbon black and 2.7 g/m$^2$ of gelatin;

(4) a layer containing 0.50 g/m$^2$ of a cyan dye releasing redox compound of the following structure, 0.50 g/m$^2$ of N,N-diethyllaurylamide, and 1.5 g/m$^2$ of gelatin;

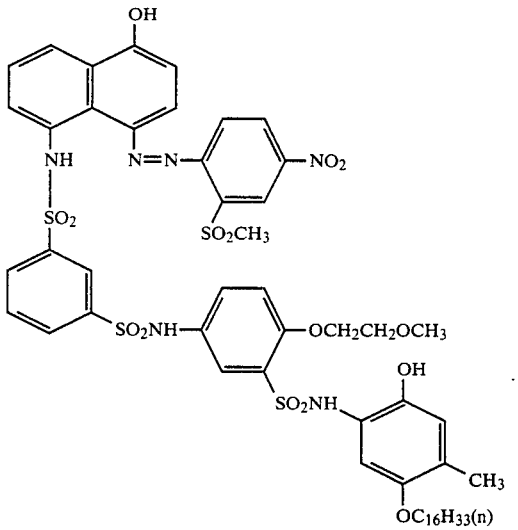

(5) a spacer layer containing 0.3 g/m$^2$ of titanium dioxide and 0.68 g/m$^2$ of gelatin;

(6) a layer containing a red-sensitive internal latent image type silver bromide direct positive emulsion (gelatin: 5.6 g/m$^2$, silver: 1.4 g/m$^2$), 1-acetyl-2-[4-(2,4-di-t-pentylphenoxyacetamido)phenyl]hydrazine (0.015 g/m$^2$), and sodium 2-pentadecylhydroquinone-5-sulfonate (0.13 g/m$^2$); and (7) a protective layer containing gelatin (0.5 g/m$^2$).

As a comparative sample for Light-Sensitive Element I of the present invention, Ligh-Sensitive Element II was prepared in the same manner as Light-Sensitive Sensitive Element I except for changing the formulation of the red-sensitive internal latent image type direct positive emulsion layer (6) to that of the following layer (6'):

(6') a layer containing a red-sensitive internal latent image type direct positive silver bromide emulsion (gelatin: 1.2 g/m$^2$, silver: 1.4 g/m$^2$), 1-acetyl-2-[4-(2,4-di-t-pentylphenoxyacetamido)phenyl]hydrazine (0.015 g/m$^2$), and sodium 2-pentadecylhydroquinone-5-sulfonate (0.13 g/m$^2$).

A cover sheet was prepared by coating the following layers, in the order recited, on a transparent polyethylene terephthalate film support:

(1) a neutralizing layer comprising polyacrylic acid (10 g/m$^2$); and (2) a timing layer comprising acetyl cellulose (10 g/m$^2$).

Each of the photographic elements was exposed through an optical wedge of 0.2 in density difference using a 2,854° K. tungsten light (maximum exposure amount in this situation being 10 C.M.S.).

Each of the exposed photographic elements and the following viscous processing solution retained in a container were passed between a pair of juxtaposed pressure applying rollers to uniformly spread the processing solution between the element and the abovedescribed cover sheet.

| Formulation of Viscous Processing Solution | |
|---|---|
| Water | 820 ml |
| 1 N $H_2SO_4$ | 5 ml |
| Hydroxyethyl Cellulose | 60 g |
| 4-Hydroxymethyl-4-methyl-1-phenyl-3-pyrazolidone | 5 g |
| 5-Methylbenzotriazole | 2 g |
| t-Butylhydroquinone | 0.4 g |
| Sodium Sulfite | 2 g |
| Carbon Black | 150 g |
| Sodium Hydroxide | 30 g |

The densities of the images were measured 1 hour after spreading the processing solution to obtain the results given in Table 1 below. The photographic images were positive images.

TABLE 1

| Photographic Element | Maximum Density | Minimum Density |
|---|---|---|
| I | 2.10 | 0.33 |
| II | 2.05 | 0.34 |

Then, the above-described Light-Sensitive Elements I and II were exposed and developed in the same manner as described above using the same cover sheet and the same processing solution after leaving them at 60° C. and 50% RH for 3 days. The densities of the images were measured 1 hour after spreading the processing solution to obtain the results given in Table 2.

TABLE 2

| Photographic Element | Maximum Density | Minimum Density |
|---|---|---|
| I | 1.90 | 0.33 |
| II | 1.55 | 0.34 |

It is seen from the above-described results that Light-Sensitive Element I having a greater binder/silver ratio shows better storage stability.

EXAMPLE 2

Light-Sensitive Element III was prepared by coating in sequence the following layers on a transparent polyethylene terephthalate film support:

(1) a mordanting layer containing copoly(sytrene-N-vinylbenzyl-N,N,N-trihexylammonium chloride) (3.0 g/m$^2$) and gelatin (3.0 g/m$^2$);

(2) a light-reflecting layer containing titanium dioxide (20 g/m$^2$) and gelatin (2.0 g/m$^2$);

(3) a light barrier layer containing carbon black (3.0 g/m$^2$) and gelatin (2 g/m$^2$);

(4) a layer containing a cyan dye releasing redox compound of the following structure (0.44 g/m$^2$), trichclohexyl phosphate (0.09 g/m$^2$), 2,5-di-t-pentadecylhydroquinone (0.008 g/m$^2$), and gelatin (0.8 g/m$^2$);

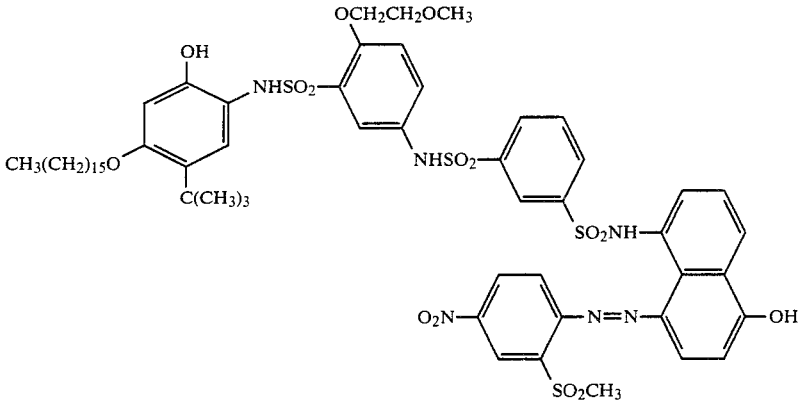

(5) a spacer layer containing 0.3 g/m$^2$ of titanium dioxide and 0.68 g/m$^2$ of gelatin;

(6) a layer containing, as a first red-sensitive emulsion layer, a direct positive emulsion containing internal latent image type silver bromide grains of 0.8 μm in average grain size spectrally sensitized with the following sensitizing dye (gelatin: 1.52 g/m$^2$, silver: 0.33 g/m$^2$), a nucleating agent of the following structure, and 2-sulfo-5-n-pentadecylhydroquinone sodium salt (0.04 g/m$^2$);

Red-Sensitizing Dye

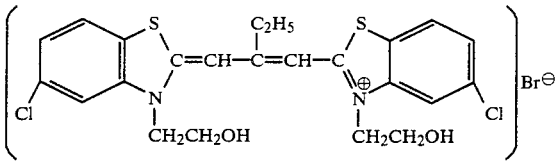

(0.03 mg/m$^2$)

Nucleating Agent

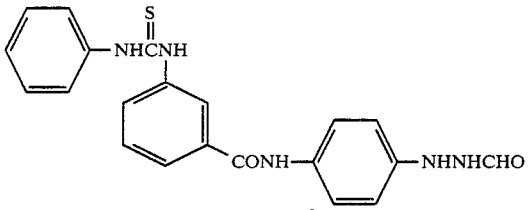

(0.013 mg/m$^2$)

(7) a layer containing, as a second red-sensitive emulsion layer, a direct positive emulsion containing internal latent image type silver bromide grains of 1.3 μm in average grain size spectrally sensitized with the above-described sensitizing dye (0.07 mg/m$^2$) (gelatin: 0.82 g/m$^2$, silver: 0.7 g/m$^2$), the above-described nucleating agent (0.027 mg/m$^2$), and 2-sulfo-5-n-pentadecylhydroquinone sodium salt (0.09 g/m$^2$);

(8) a layer containing a compound of the following structural formula (0.43 g/m$^2$), trihexyl phosphate (0.1 g/m$^2$) and gelatin (0.4 g/m$^2$);

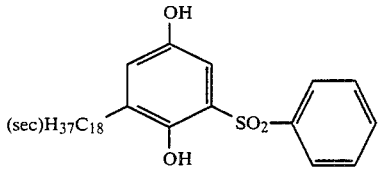

(9) a layer containing a magenta dye releasing redox compound of the following structural formula (0.21 g/m$^2$), tricyclohexyl phosphate (0.08 g/m$^2$), 2,5-di-t-pentadecylhydroquinone (0.009 g/m$^2$) and gelatin (0.9 g/m$^2$);

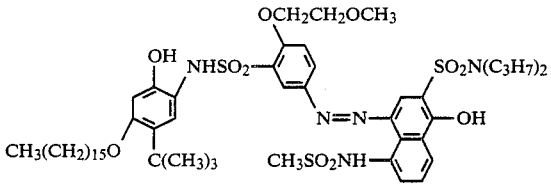

(10) a layer containing, as a first green-sensitive emulsion layer, a direct positive emulsion containing internal latent image type silver bromide grains of 1.0 μm in average grain size spectrally sensitized with the following green-sensitizing dye (gelatin: 0.36 g/m$^2$, silver: 0.33 g/m$^2$), the same nucleating agent as in layer (6) (0.012 mg/m$^2$), and 2-sulfo-5-n-pentadecylhydroquinone sodium salt (0.048 g/m$^2$);

Green-Sensitizing Dye

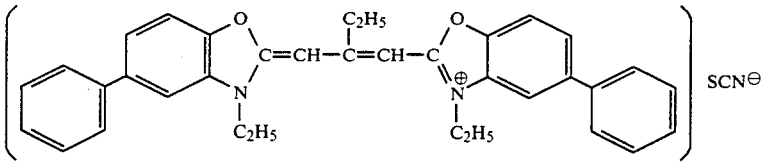

(0.06 mg/m²)

(11) a layer containing, as a second green-sensitive emulsion layer, a direct positive emulsion containing internal latent image type silver bromide grains of 1.5 μm in average grain size spectrally sensitized with the above-described green-sensitizing dye (0.09 mg/m²) (gelatin: 0.54 g/m², silver: 0.49 g/m²), the same nucleating agent as in layer (6) (0.018 mg/m²), and 2-sulfo-5-n-pentadecylhydroquinone sodium salt (0.048 g/m²);

(12) the same layer as layer (8);

(13) a layer containing a yellow dye releasing redox compound of the following structure (0.53 g/m²), tricyclohexyl phosphate (0.13 g/m²), 2,5-di-t-pentadecylhydroquinone (0.014 g/m², and gelatin (0.7 g/m²);

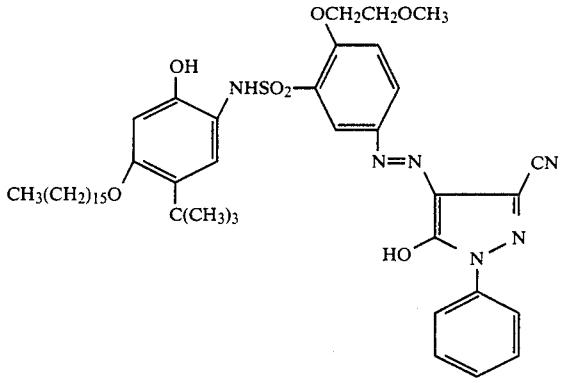

(14) a layer containing, as a first blue-sensitive emulsion layer, a direct positive emulsion containing internal latent image type silver bromide grains of 1.0 μm in average grain size (gelatin: 1.4 g/m², silver: 0.35 g/m²), the same nucleating agent as in layer (6) (0.013 mg/m²), and 2-sulfo-5-n-pentadecylhydroquinone sodium salt (0.022 g/m²);

(15) a layer containing, as a second blue-sensitive emulsion layer, a direct positive emulsion containing internal latent image type silver bromide grains of 1.5 μm in average grain size (gelatin: 1.85 g/m², silver: 0.74 g/m²), the same nucleating agent as in layer (6) (0.027 mg/m²), and 2-sulfo-5-n-pentadecylhydroquinone sodium salt (0.048 g/m²); and

(16) a layer containing gelatin (1.0 g/m²).

As a comparative sample for Light-Sensitive Element III of the present invention, Light-Sensitive Element IV of the following construction was prepared.

(a) layers (1) to (5) were absolutely the same as in Light-Sensitive Element III;

(b) layer (6) was the same as in Light-Sensitive Element III except that the amount of gelatin was 0.33 g/m²;

(c) layers (7) to (13) were absolutely the same as in Light-Sensitive Element III;

(d) layer (14) was the same as in Light-Sensitive Element III except that the amount of gelatin was 0.35 g/m²;

(e) layer (15) was the same as in Light-Sensitive Element III except that the amount of gelatin was 0.74 g/m²;

(f) layer (16) was the same as in Light-Sensitive Element III.

A cover sheet was prepared by coating in sequence the following layers (1') to (3') on a transparent polyethylene terephthalate support:

(1') a layer containing an acrylic acid/butyl acrylate copolymer (80/20 by weight) (22 g/m²) and 1,4-bis(2,3-epoxypropoxy)butane (0.44 g/m²);

(2') a layer containing acetyl cellulose (producing 39.4 g of acetyl group per 100 g when hydrolyzed) (3.8 g/m²), a styrene/maleic anhydride 60/40 (by weight) copolymer (molecular weight: about 50,000) (0.2 g/m²), and 5-(β-cyanoethylthio)-1-phenyltetrazole (0.115 g/m²); and (3') a layer containing a vinylidene chloride/methyl acrylate/acrylic acid terpolymer (85/12/3 by weight) latex (2.5 g/m²) and a polymethyl methacrylate latex (particle size: 1 to 3 μm) (0.05 g/m²).

A processing solution of the following formulation was prepared:

| | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium Sulfite (anhydrous) | 0.2 g |
| Carboxymethyl Cellulose Na Salt | 58 g |
| Potassium Hydroxide (28% aq. soln.) | 200 ml |
| Benzyl Alcohol | 1.5 ml |
| Carbon Black | 150 g |
| Water | 685 ml |

Maximum densities of fresh light-sensitive elements after the exposure and spreading procedure (called "Fresh") and maximum densities of them subjected to exposure and a processing solution spreading procedure after being left at 60° C. and 50% RH for 3 days, and maximum densities of them separately subjected to exposure and a processing solution spreading procedure after being left at 45° C. and 80% RH for 3 days are shown in Table 3.

The exposure conditions were the same as in Example 1, and the processing solution spreading procedure was the same as in Example 1. The thickness of the spread processing solution was 80 μm.

TABLE 3

| Light-Sensitive Element | | Fresh | 60° C. 50% RH for 3 Days | 45° C. 80% RH for 3 Days | Note |
|---|---|---|---|---|---|
| III | B | 1.8 | 1.70 | 1.55 | Present |
| | G | 2.0 | 1.90 | 1.80 | Invention |

TABLE 3-continued

| Light-Sensitive Element | | Fresh | 60° C. 50% RH for 3 Days | 45° C. 80% RH for 3 Days | Note |
|---|---|---|---|---|---|
| | R | 2.2 | 1.95 | 1.80 | |
| IV | B | 1.8 | 1.65 | 1.40 | Comparison |
| | G | 2.0 | 1.90 | 1.80 | |
| | R | 2.15 | 1.75 | 1.80 | |

It is seen from Table 3 that Light-Sensitive Element III having a larger binder/silver ratio (in the red- and blue-sensitive layers in this Example) showed better storage stability.

Additionally, Light-Sensitive Elements III and IV showed the same minimum density.

EXAMPLE 3

Light-Sensitive Element V was prepared by coating the following layers, in the order recited, on a polyethylene terephthalate film support containing 12 wt % carbon black kneaded therein to show light shielding properties:

(1) a layer containing a yellow dye releasing redox compound of the following structure (1.0 g/m$^2$), N,N-diethyllaurylamide (0.25 g/m$^2$), and gelatin (1.0 g/m$^2$);

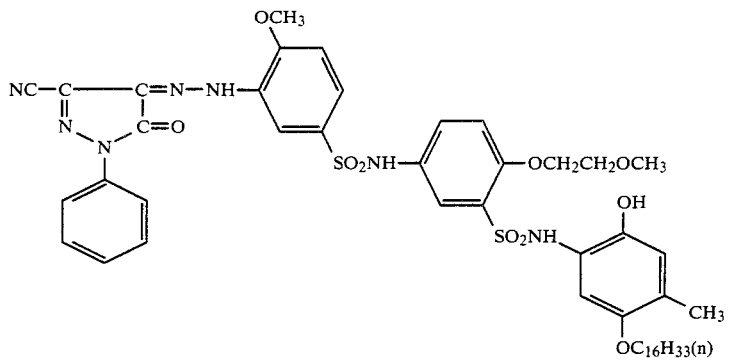

(2) a spacer layer containing titanium dioxide (0.2 g/m$^2$) and gelatin (0.4 g/m$^2$);

(3) a layer containing a blue-sensitive internal latent image type silver bromide direct positive emulsion (gelatin: 4.2 g/m$^2$, silver: 1.4 g/m$^2$), 1-acetyl-2-[4-(2,4-di-t-pentylphenoxyacetamido)phenyl]hydrazine (0.015 g/m$^2$), and sodium 2-pentadecylhydroquinone-5-sulfonate (0.075 g/m$^2$); and (4) a layer containing gelatin (1.0 g/m$^2$).

Light-Sensitive Element VI was prepared in the same manner as Light-Sensitive Element V except that the gelatin amount in layer (3) was 1.1 g/m$^2$.

The above-described Light-Sensitive Elements V and VI were exposed in three different manners: (a) being exposed immediately (called "Fresh"); (b) being exposed after leaving at 60° C. and 50% RH for 3 days; and (c) being exposed after leaving at 45° C. and 80% RH for 3 days.

Exposure was conducted in the same manner as in Example 1.

Separately, an image receiving sheet was prepared by coating the following layers, in the order recited, on the opposite side of paper support to the side laminated with polyethylene containing carbon black to show light shielding properties:

(1) a 7 μm thick neutralizing layer containing 17 g/m$^2$ of polyacrylic acid, 0.06 g/m$^2$ of N-hydroxysuccinimidobenzenesulfonate, and 0.5 g/m$^2$ of ethylene glycol;

(2) a 2 μm thick timing layer of cellulose acetate (acid degree: 54);

(3) a 4 μm thick timing layer of a vinylidene chloride/acrylic acid copolymer latex:

(4) an image receiving layer containing 4.0 g/m$^2$ of copoly(styrene-N-vinylbenzyl-N,N,N-trihexylammonium chloride) and 4.0 g/m$^2$ of gelatin: and (5) a peel-apart layer containing phthaloylated gelatin (2.0 g/m$^2$).

Each of the above-described, exposed light-sensitive elements was superposed on the image receiving element, and a container (rupturable by pressure) retaining the following processing composition was disposed at the end of the assembly. The thus constituted film units were pressed between a pair of juxtaposed rollers to spread the composition therebetween in a thickness of 80 μm.

| Processing Composition | |
|---|---|
| Potassium Hydroxide | 56 g |
| 4-Hydroxymethyl-4-methyl-1-tolyl-3-pyrazolidine | 6 g |
| 5-Methylbenzotriazole | 5 g |
| Methylhydroquinone | 0.2 g |
| Sodium Sulfite | 0.8 g |
| Benzyl Alcohol | 2 ml |
| Hydroxyethyl Cellulose | 50 g |
| Water to make the total | 1 liter |

The results thus obtained are shown in Table 4.

TABLE 4

| Light-Sensitive Material | Fresh | 60° C., 50% RH for 3 Days | 45° C., 80% RH for 3 Days | Note |
|---|---|---|---|---|
| Light-Sensitive Element V | 2.3 | 2.1 | 1.9 | Present Invention |
| Light-Sensitive Element VI | 2.3 | 2.0 | 1.7 | Comparison |

It can be seen from the results in Table 4 that Light-Sensitive Element V having a larger binder/silver ratio showed better storage stability.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one internal latent image direct positive silver halide emulsion layer, wherein:

(1) said internal latent image direct positive silver halide emulsion layer comprises at least two layers having substantially the same color sensitivity but differing in speed, or (2) at least said internal latent image direct positive silver halide emulsion and a solid pigment-containing layer contiguous thereto, which is positioned on the side opposite to the side of the silver halide emulsion layer to be exposed, are provided, and wherein at least one internal latent image direct positive silver halide emulsion in (1) or (2) has a binder/silver halide (calculated as silver) ratio by weight of more than 1.25.

2. The silver halide photographic light-sensitive material as claimed in claim 1, wherein said binder/silver ratio is more than 2.0.

3. The silver halide photographic light-sensitive material as claimed in claim 2, wherein said binder/silver ratio is more than 3.0.

4. The silver halide photographic light-sensitive material as claimed in claim 1, wherein the pigment in said solid pigment-containing layer is selected from the group consisting of titanium oxide, zinc oxide, zirconium oxide, white lead, zinc sulfide, cadmium yellow, cobalt silver, cobalt blue, cadmium red, ultramarine, indanthrone blue, phthalocyanine blue and pearl pigments.

5. The silver halide photographic light-sensitive material as claimed in claim 4, wherein the pigment in said solid pigment-containing layer is selected from the group consisting of titanium oxide, zirconium oxide and pearl pigments.

6. The silver halide photographic light-sensitive material as claimed in claim 1, wherein the coating amount of pigment in said solid pigment-containing layer is about 10 $g/m^2$ or less.

7. The silver halide photographic light-sensitive material as claimed in claim 6, wherein the coating amount ranges from 0.5 to 4 $g/m^2$.

* * * * *